US009698471B2

(12) United States Patent
Chiu

(10) Patent No.: US 9,698,471 B2
(45) Date of Patent: Jul. 4, 2017

(54) ELECTRONIC DEVICE

(71) Applicant: Acer Incorporated, New Taipei (TW)

(72) Inventor: Pei-Yuan Chiu, New Taipei (TW)

(73) Assignee: Acer Incorporated, New Taipei (TW)

( * ) Notice: Subject to any disclaimer, the term of this patent is extended or adjusted under 35 U.S.C. 154(b) by 78 days.

(21) Appl. No.: 14/705,988

(22) Filed: May 7, 2015

(65) Prior Publication Data

US 2016/0233572 A1 Aug. 11, 2016

(30) Foreign Application Priority Data

Feb. 10, 2015 (TW) ..... 104104369 A

(51) Int. Cl.
*H01Q 1/24* (2006.01)
*H01Q 21/28* (2006.01)
*H01Q 1/52* (2006.01)

(52) U.S. Cl.
CPC ..... *H01Q 1/243* (2013.01); *H01Q 1/525* (2013.01); *H01Q 21/28* (2013.01)

(58) Field of Classification Search
CPC ..... H01Q 1/243; H01Q 21/28
USPC ..... 343/702, 725, 729, 741, 829, 846, 343/700 MS
See application file for complete search history.

(56) References Cited

U.S. PATENT DOCUMENTS

| | | | | |
|---|---|---|---|---|
| 7,345,638 | B1 * | 3/2008 | Tan | H01Q 1/38 343/700 MS |
| 7,403,165 | B2 * | 7/2008 | Qi | H01Q 1/243 343/700 MS |
| 8,872,708 | B2 * | 10/2014 | Hill | H01Q 1/243 343/702 |
| 9,002,262 | B1 * | 4/2015 | Kuo | H01Q 1/50 343/702 |
| 9,048,528 | B1 * | 6/2015 | Lee | H01Q 5/30 |
| 9,325,070 | B1 * | 4/2016 | Obeidat | H01Q 9/0407 |
| 2016/0233572 | A1 * | 8/2016 | Chiu | H01Q 21/28 |

FOREIGN PATENT DOCUMENTS

| | | |
|---|---|---|
| TW | M405060 | 6/2011 |
| TW | M470479 | 1/2014 |
| TW | 201417390 | 5/2014 |
| TW | 1442631 | 6/2014 |

* cited by examiner

*Primary Examiner* — Tho G Phan
(74) *Attorney, Agent, or Firm* — Jianq Chyun IP Office

(57) ABSTRACT

An electronic device including a touch screen, a first back cover, a transmitting antenna and a receiving antenna is provided. The first back cover includes a frame and a cover body. The transmitting antenna is adjacent to an edge of the touch screen and has a feeding point for receiving a feeding signal. The receiving antenna is adjacent to the cover body of the first back cover and is electrically connected to a ground plane. The receiving antenna and the transmitting antenna are spaced apart by a coupling distance, and a signal from the receiving antenna is transmitted to the feeding point through the coupling distance and the transmitting antenna.

12 Claims, 3 Drawing Sheets

ELECTRONIC DEVICE

CROSS-REFERENCE TO RELATED APPLICATION

This application claims the priority benefit of Taiwan application serial no. 104104369, filed on Feb. 10, 2015. The entirety of the above-mentioned patent application is hereby incorporated by reference herein and made a part of this specification.

BACKGROUND

Technical Field

The invention relates to an electronic device, and particularly relates to an electronic device having a transmitting antenna and a receiving antenna.

Related Art

Along with quick development of technology, various electronic devices are developed one after another, and the electronic devices have become indispensable portable equipment in people's daily life, such as smart phones, tablet personal computers (PCs) and notebooks, etc. Generally, a plurality of antennas (for example, a WiFi antenna, a GPS antenna, etc.) have to be built in the existing electronic devices for respectively supporting various communication functions. Moreover, in order to avoid electromagnetic waves jeopardizing human health, the electronic devices have to pass through a specific absorption rate (SAR) detection of a safety test before a public sale of the electronic devices.

However, along with a development trend of miniature design of the electronic devices, a space used for setting antennas in the electronic devices is relatively compressed. Moreover, in order to comply with the SAR value of the test standard, setting positions of the antennas in the electronic devices are generally limited. Therefore, under a limited space and the standard of the SAR value, isolation between the antennas in the electronic devices is poor, which decreases communication quality of the electronic devices.

SUMMARY

The invention is directed to an electronic device, in which a transmitting antenna and a receiving antenna are respectively adjacent to a touch screen and a first back cover, and the transmitting antenna and the receiving antenna adopt a single feeding structure. In this way, a disposition space of the receiving antenna and the transmitting antenna is decreased, and a problem of isolation between the transmitting antenna and the receiving antenna is resolved.

The invention provides an electronic device including a touch screen, a first back cover, a transmitting antenna and a receiving antenna. The first back cover includes a frame and a cover body. The transmitting antenna is adjacent to an edge of the touch screen and has a feeding point for receiving a feeding signal. The receiving antenna is adjacent to the cover body of the first back cover and is electrically connected to a ground plane. The receiving antenna and the transmitting antenna are spaced apart by a coupling distance, and a signal from the receiving antenna is transmitted to the feeding point through the coupling distance and the transmitting antenna.

According to the above description, the transmitting antenna and the receiving antenna in the electronic device are respectively adjacent to the touch screen and the first back cover, such that the electronic device is complied with the SAR value of the test standard. Moreover, the transmitting antenna and the receiving antenna adopt a single feeding structure. In this way, a disposition space of the receiving antenna and the transmitting antenna is decreased, and a problem of isolation between the transmitting antenna and the receiving antenna is resolved, so as to effectively improve the communication quality of the electronic device.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
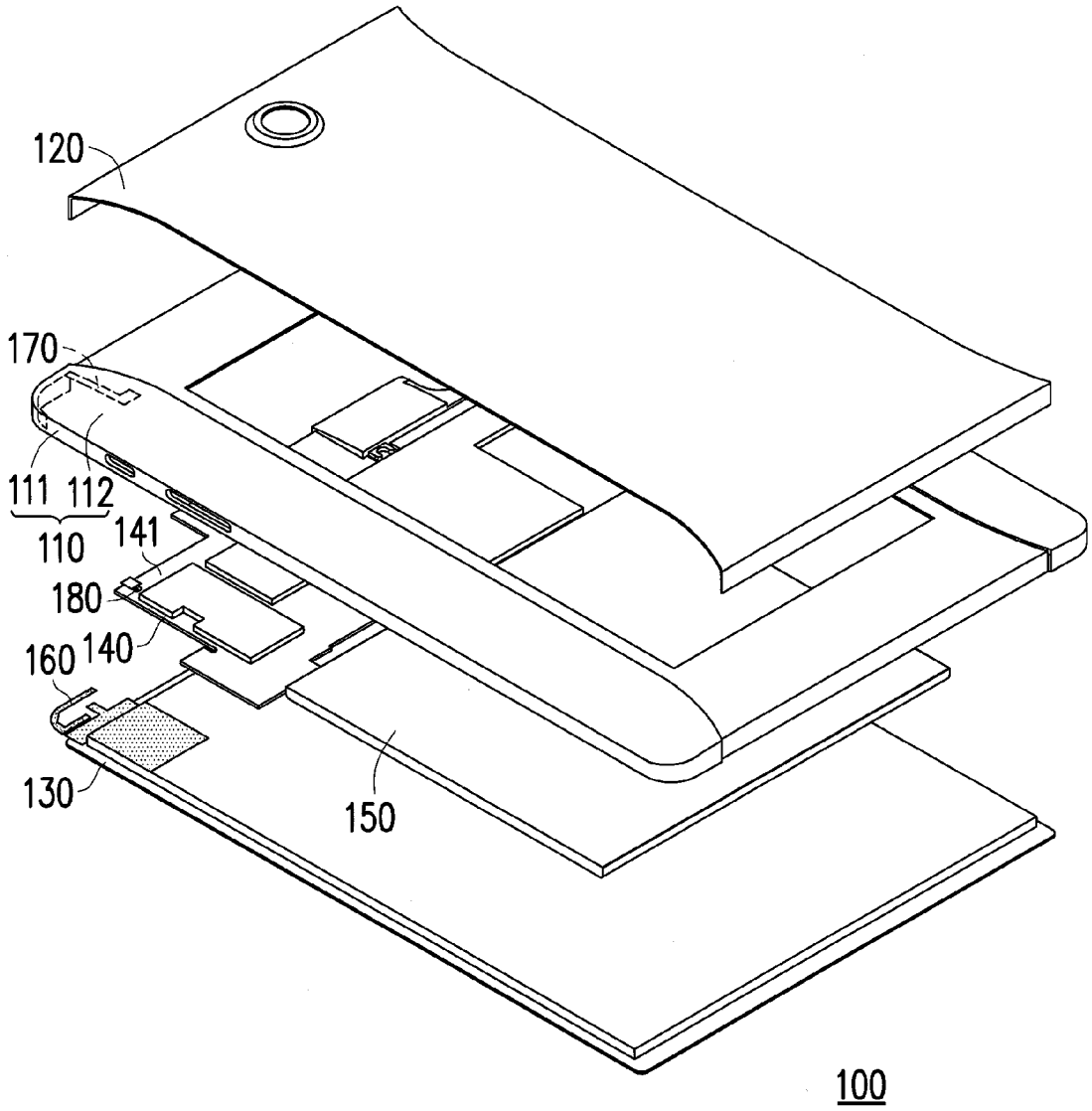
FIG. 1 is an exploded view of an electronic device according to an embodiment of the invention.

FIG. 1 is an exploded view of an electronic device according to an embodiment of the invention. As shown in FIG. 1, the electronic device 100 includes a first back cover 110, a second back cover 120, a touch screen 130, a substrate 140, a battery 150, a transmitting antenna 160 and a receiving antenna 170. The first back cover 110 has an engagement structure, and the second back cover 120 can be fixed outside the first back cover 110 through the engagement structure. Moreover, the first back cover 110 includes a frame 111 and a cover body 112. It should be noticed that the first back cover 110 and the second back cover 120 are all a part of a housing of the electronic device 100, and the housing of the electronic device 110 forms a containing space. Moreover, the containing space is used for containing internal elements of the electronic device 100 such as the touch screen 130, the substrate 140, the battery 150, the transmitting antenna 160, the receiving antenna 170, etc.

Further, the substrate 140 and the battery 150 are disposed between the first back cover 110 and the touch screen 130. Moreover, the substrate 140 is, for example, a system circuit board, and the substrate 140 is configured with a ground plane 141. In addition, the transmitting antenna 160 is adjacent to an edge of the touch screen 130. The receiving antenna 170 is adjacent to the cover body 112 of the first back cover 110. In other words, in view of the whole configuration, the transmitting antenna 160 is adjacent to a front surface of the electronic device 100, and the receiving antenna 170 is adjacent to a back surface of the electronic device 100.

It should be noticed that in detection of a specific absorption rate (SAR) value, the back surface or a side surface of the electronic device 100 is taken as a measurement reference surface to measure a power absorbed by a unit of mass of exposed tissue of a person when exposed to the electromagnetic radiation of the electronic device 100. Since the transmitting antenna 160 is adjacent to the front surface of the electronic device 100, during the detection, the transmitting antenna 160 can be away from the measurement reference surface, such that the measured SAR value can be complied with a test standard. Moreover, the receiving antenna 170 is only used for signal reception. Therefore, the receiving antenna 170 has lower radiation energy, so as to comply with the test standard of the SAR value.

Figure 2:
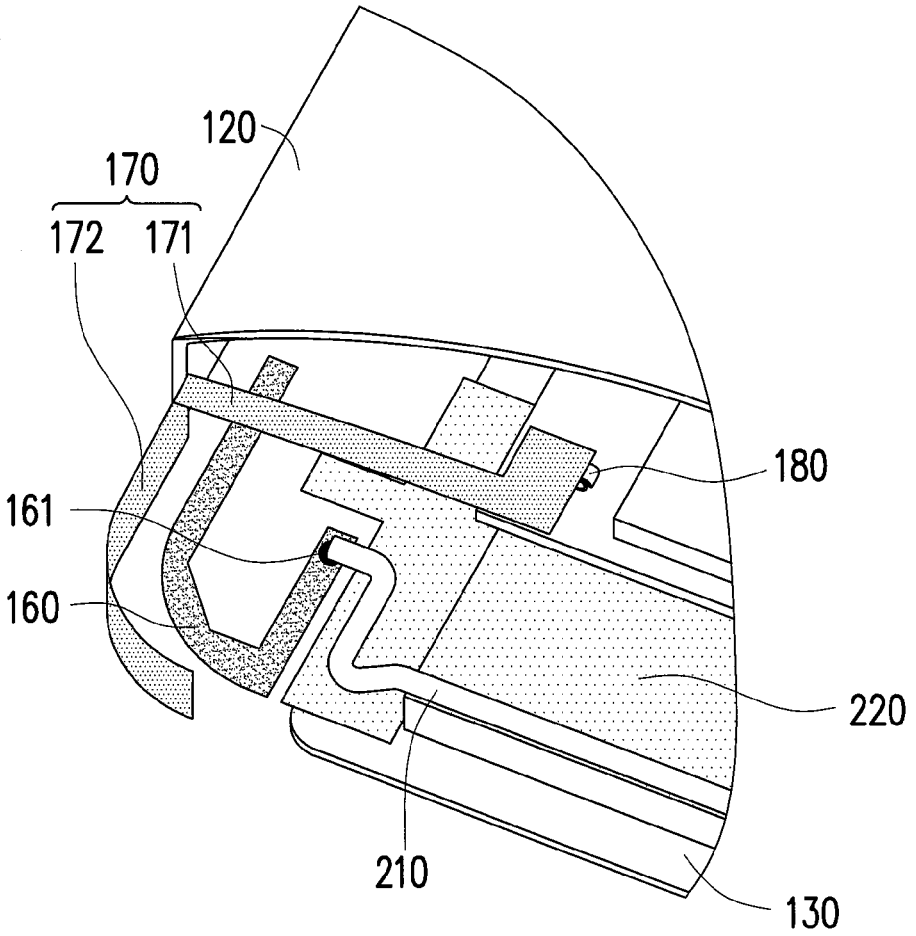
FIG. 2 is a partial back view of the electronic device according to an embodiment of the invention.
Figure 3:
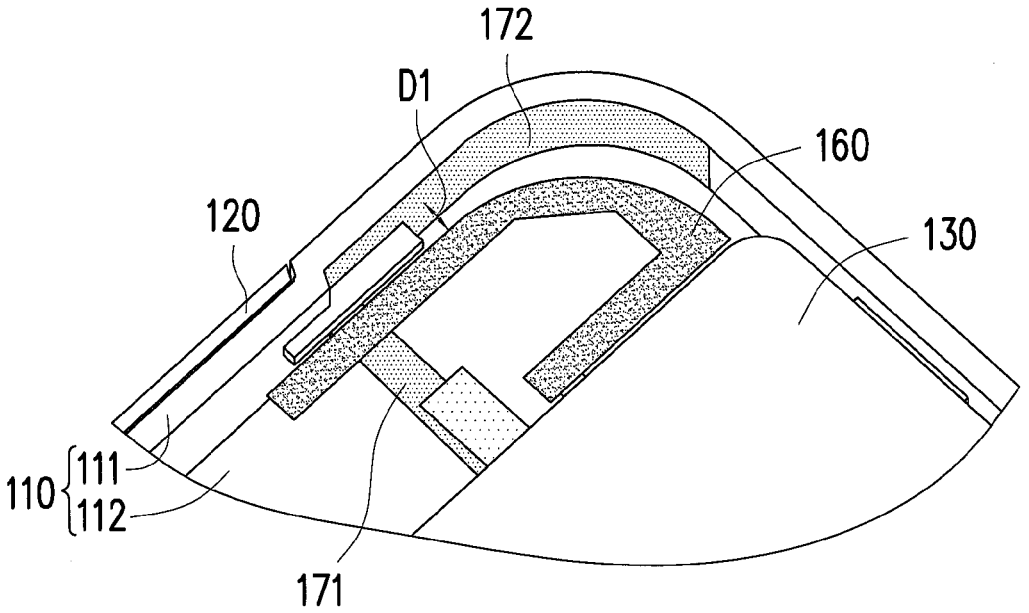
FIG. 3 is a partial front view of the electronic device according to an embodiment of the invention.

In order to make a full understanding of the structures and operations of the transmitting antenna 160 and the receiving antenna 170, figures are provided below for description. FIG. 2 is a partial back view of the electronic device according to an embodiment of the invention, and FIG. 3 is a partial front view of the electronic device according to an embodiment of the invention. In the embodiment of FIG. 2 and FIG. 3, the first back cover 110 is, for example, a plastic back cover, and the second back cover 120 is, for example, a metal back cover. Namely, the frame 111 and the cover body 112 of the first back cover 110 are made of a non-conductive material, and the second back cover 120 is made of a metal material. Moreover, an orthogonal projection of the second back cover 120 on the first back cover 110 is not overlapped with an orthogonal projection of the receiving antenna 170 on the first back cover 110, and an orthogonal projection of the second back cover 120 on the first back cover 110 is not overlapped with an orthogonal projection of the transmitting antenna 160 on the first back cover 110.

Further, the transmitting antenna 160 has a feeding point 161. Moreover, the transmitting antenna 160 and the receiving antenna 170 are spaced apart by a coupling distance D1. The receiving antenna 170 is electrically connected to the ground plane 141, and is adhered to an inner side of the first back cover 110. For example, the receiving antenna 170 includes a first radiation element 171 and a second radiation element 172. The first radiation element 171 is disposed at the inner side of the cover body 112 and is electrically connected to the ground plane 141. For example, in an embodiment, the electronic device 100 further includes a conductive elastic piece 180. Moreover, the conductive elastic piece 180 is disposed on the ground plane 141, and the first radiation element 171 is electrically connected to the ground plane 141 through the conductive elastic piece 180. The second radiation element 172 is disposed at an inner side of the frame 111, and the second radiation element 172 is electrically connected to the first radiation element 171. Moreover, the second radiation element 172 and the transmitting antenna 160 are spaced apart by the coupling distance D1.

In view of the whole configuration, an orthogonal projection of the first radiation element 171 on the first back cover 110 is partially overlapped with an orthogonal projection of the transmitting antenna 160 on the first back cover 110. Namely, the receiving antenna 170 and the transmitting antenna 160 are configured at a same corner of the electronic device 100, so that a disposition space of the e receiving antenna 170 and the transmitting antenna 160 is reduced. Moreover, in view of operation, the transmitting antenna 160 can receive a feeding signal through the feeding point 161. In this way, through excitation of the feeding signal, the transmitting antenna 160 can transmit an electromagnetic wave in a first frequency band (for example, a WiFi band). Moreover, since the receiving antenna 170 and the transmitting antenna 160 are spaced apart by the coupling distance D1, the transmitting antenna 160 is equivalent to a feeding signal source of the receiving antenna 170, so that the receiving antenna 170 may excite a resonant mode in a second frequency band (for example, a GPS band). Therefore, the electronic device 100 can receive an electromagnetic wave in the second frequency band (for example, the GPS band) through the receiving antenna 170, and a signal from the receiving antenna 170 can be transmitted to the feeding point 161 through the coupling distance D1 and the transmitting antenna 160.

In other words, the transmitting antenna 160 and the receiving antenna 170 can form a multi-band antenna with a single feeding structure (i.e. a single-end structure), so as to resolve the problem of isolation between the transmitting antenna 160 and the receiving antenna 170, and effectively improve the communication quality of the electronic device 100. For example, if the transmitting antenna 160 and the receiving antenna 170 adopt a dual feeding structure, i.e. the transmitting antenna 160 and the receiving antenna 170 respectively have a feeding point, the transmitting antenna 160 and the receiving antenna 170 may have the problem of isolation therebetween, so that an antenna efficiency of the antenna 170 is only 20-30%. However, in the present embodiment, the transmitting antenna 160 and the receiving antenna 170 adopt the single feeding structure, and the problem of isolation between the transmitting antenna 160 and the receiving antenna 170 is eliminated, so that the antenna efficiency of hat in an actual application, the feeding point 161 of the transmitting antenna 160 can be electrthe antenna 170 can be enhanced to 40-50%.

It should be noticed tically connected to a transceiver (not shown) disposed on the substrate 140 through a coaxial cable, a conductive elastic piece or a pogo-pin. For example, as shown in FIG. 2, the feeding point 161 of the transmitting antenna 160 can be electrically connected to a transceiver on the substrate 140 through a coaxial cable 210. In this way, the transceiver can transmit the feeding signal to the feeding point 161 to excite the transmitting antenna 160, and the transceiver can also receive the signal from the antenna 170 through the feeding point 161. The electronic device 100 further includes a conductive element 220 disposed on the touch screen 130, and the conductive element 220 is electrically connected to the ground plane 141. Moreover, an inner conductor of the coaxial cable 210 is electrically connected to the feeding point 161 of the transmitting antenna 160, and an outer conductor of the coaxial cable 210 is electrically connected to the conductive element 220.

Moreover in the embodiment of FIG. 1 to FIG. 3, the receiving antenna 170 is formed by combining the two radiation elements 171 and 172. In the embodiment of FIG. 1 to FIG. 3, although an implementation of the receiving antenna 170 is provided, the invention is not limited thereto, and those skilled in the art can also implement the receiving antenna 170 by using the housing of the electronic device 100 according to an actual design requirement. For example, FIG. 4 is a partial back view of an electronic device according to another embodiment of the invention, and FIG. 5 is a partial front view of the electronic device according to the other embodiment of the invention.

Figure 4:
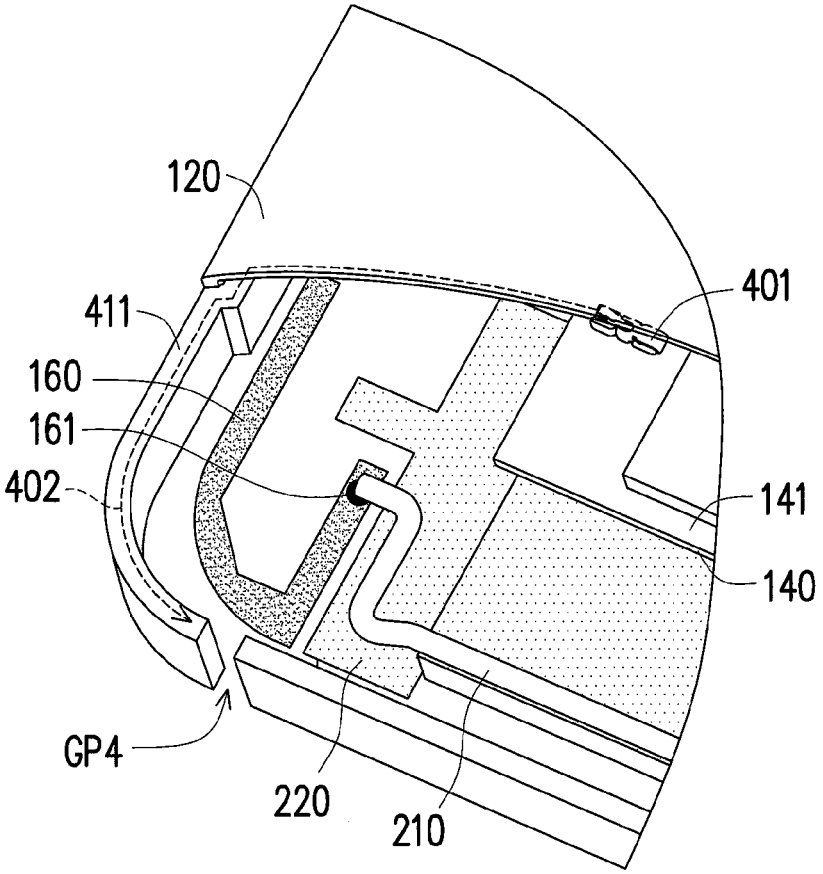
FIG. 4 is a partial back view of an electronic device according to another embodiment of the invention.
Figure 5:
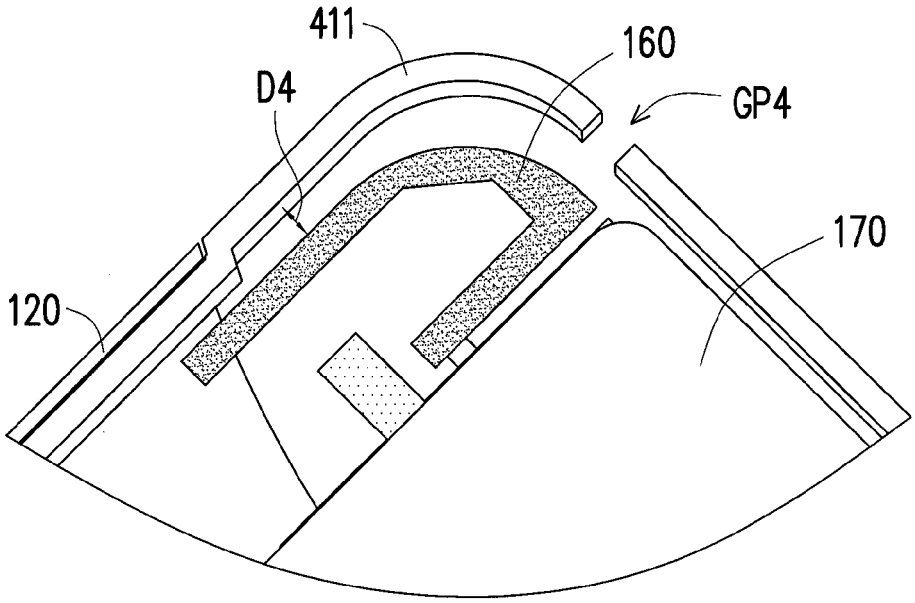
FIG. 5 is a partial front view of the electronic device according to the other embodiment of the invention.

To be specific, the electronic device shown in FIGS. 4-5 is an extension of the electronic device 100 of the embodiment of FIGS. 1-3. In the embodiment of FIGS. 4-5, the first back cover 110 is, for example, a plastic back cover having a metal frame, and the second back cover 120 is, for example, a metal back cover. Namely, the first back cover 110 includes a frame 411 made of a metal material as shown in FIGS. 4-5 and the cover body 112 made of a non-conductive material as shown in FIG. 1. Moreover, the frame 411 has a gap GP4, and a part of the frame 411 and the transmitting antenna 160 are spaced apart by a coupling distance D4. In addition, a conductive elastic piece 401 is disposed on the ground plane 141 and is electrically connected to the ground plane 141. The second back cover 120 is electrically connected to the frame 411, and is electrically connected to the ground plane 141 through the conductive elastic piece 401. In this way, a part of the second back cover 120 and a part of the frame 411 can form a receiving antenna. For example, a part of the second back cover 120 and a part of the frame 411 can form a resonant path 402. Moreover, the transmitting antenna 160 is equivalent to a feeding signal source of the receiving antenna, so that the receiving antenna may excite a resonant mode in the second frequency band (for example, the GPS band) through the resonant path 402. Detailed operations of the other components in the embodiment of FIGS. 4-5 may refer to the embodiment of FIGS. 1-3, and details thereof are not repeated.

In summary, the transmitting antenna and the receiving antenna in the electronic device are respectively adjacent to the touch screen and the first back cover, such that the electronic device is complied with the SAR value of the test standard. Moreover, the transmitting antenna and the receiving antenna may form a multi-band antenna with a single feeding structure. In this way, a disposition space of the receiving antenna and the transmitting antenna is decreased, and a problem of isolation between the transmitting antenna and the receiving antenna is resolved, so as to effectively improve the communication quality of the electronic device.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An electronic device, comprising:

a touch screen;

a first back cover, comprising a frame and a cover body;

a transmitting antenna, adjacent to an edge of the touch screen and having a feeding point for receiving a feeding signal; and a receiving antenna, adjacent to the cover body of the first back cover, and electrically connected to a ground plane, wherein the receiving antenna and the transmitting antenna are spaced apart by a coupling distance, and a signal from the receiving antenna is transmitted to the feeding point through the coupling distance and the transmitting antenna.

2. The electronic device as claimed in claim 1, wherein the frame and the cover body are made of a non-conductive material, and the receiving antenna comprises:

a first radiation element, disposed at an inner side of the cover body, and electrically connected to the ground plane; and a second radiation element, disposed at an inner side of the frame, and electrically connected to the first radiation element, wherein the second radiation element and the transmitting antenna are spaced apart by the coupling distance.

3. The electronic device as claimed in claim 2, further comprising:

a substrate, disposed between the first back cover and the touch screen, and the ground plane being disposed on the substrate; and a conductive elastic piece, disposed on the ground plane, and the first radiation element being electrically connected to the ground plane through the conductive elastic piece.

4. The electronic device as claimed in claim 2, wherein an orthogonal projection of the first radiation element on the first back cover is partially overlapped with an orthogonal projection of the transmitting antenna on the first back cover.

5. The electronic device as claimed in claim 4, further comprising:

a second back cover, fixed outside the first back cover, and made of a metal material, wherein an orthogonal projection of the second back cover on the first back cover is not overlapped with an orthogonal projection of the receiving antenna on the first back cover, and the orthogonal projection of the second back cover on the first back cover is not overlapped with the orthogonal projection of the transmitting antenna on the first back cover.

6. The electronic device as claimed in claim 1, further comprising:

a second back cover, fixed outside the first back cover, wherein the second back cover and the frame are made of a metal material, the cover body is made of a non-conductive material, the frame has a gap, and the receiving antenna is composed of a part of the second back cover and a part of the frame.

7. The electronic device as claimed in claim 6, further comprising:

a substrate, disposed between the first back cover and the touch screen, and the ground plane being configured on the substrate; and a conductive elastic piece, disposed on the ground plane, and the second back cover being electrically connected to the ground plane through the conductive elastic piece.

8. The electronic device as claimed in claim 1, further comprising:

a battery, disposed between the first back cover and the touch screen.

9. The electronic device as claimed in claim 1, wherein the transmitting antenna and the receiving antenna form a multi-band antenna with a single feeding structure.

10. The electronic device as claimed in claim 9, wherein the multi-band antenna emits an electromagnetic wave in a first frequency band through the transmitting antenna, and receives an electromagnetic wave in a second frequency band through the receiving antenna.

11. An electronic device, comprising:

a touch screen;

a first back cover, comprising a frame and a cover body;

a transmitting antenna, adjacent to an edge of the touch screen and having a feeding point for receiving a feeding signal; and a receiving antenna, adjacent to the cover body of the first back cover, and electrically connected to a ground plane, wherein the receiving antenna and the transmitting antenna are spaced apart by a coupling distance, and a signal from the receiving antenna is transmitted to the feeding point through the coupling distance and the transmitting antenna, and wherein the frame and the cover body are made of a non-conductive material, and the receiving antenna comprises:

a first radiation element, disposed at an inner side of the cover body, and electrically connected to the ground plane; and a second radiation element, disposed at an inner side of the frame, and electrically connected to the first radiation element, wherein the second radiation element and the transmitting antenna are spaced apart by the coupling distance.

12. An electronic device, comprising:

a touch screen;

a first back cover, comprising a frame and a cover body;

a transmitting antenna, adjacent to an edge of the touch screen and having a feeding point for receiving a feeding signal;

a receiving antenna, adjacent to the cover body of the first back cover, and electrically connected to a ground plane, wherein the receiving antenna and the transmitting antenna are spaced apart by a coupling distance, and a signal from the receiving antenna is transmitted to the feeding point through the coupling distance and the transmitting antenna; and a second back cover, fixed outside the first back cover, wherein the second back cover and the frame are made of a metal material, the cover body is made of a non-conductive material, the frame has a gap, and the receiving antenna is composed of a part of the second back cover and a part of the frame.

* * * * *